US006302205B1

(12) United States Patent
Ryll

(10) Patent No.: US 6,302,205 B1
(45) **Date of Patent: *Oct. 16, 2001**

(54) METHOD FOR LOCATING A DRILL BIT WHEN DRILLING OUT CEMENTING EQUIPMENT FROM A WELLBORE

(75) Inventor: Robert Lawrence Ryll, Sherwood Park (CA)

(73) Assignee: Top-Co Industries Ltd. (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,931

(22) Filed: Jun. 4, 1999

(30) Foreign Application Priority Data

Jun. 5, 1998 (CA) ..... 2239645

(51) Int. Cl.[7] ..... E21B 47/09

(52) U.S. Cl. ..... 166/250.12; 166/113; 166/242.8; 166/250.14; 166/376; 166/285.1

(58) Field of Search ..... 166/250.12, 252.6, 166/242.8, 113, 253.1, 250.14, 285, 291, 177.4, 376, 255.1

(56) References Cited

U.S. PATENT DOCUMENTS 2,183,654 * 12/1939 Moore ..... 166/255.1
2,254,246 * 9/1941 Scaramucci ..... 166/113
2,439,542 * 4/1948 Hunt ..... 166/113
3,991,827 * 11/1976 Schall ..... 166/253
4,008,763 * 2/1977 Lowe, Jr. ..... 166/253
4,083,406 * 4/1978 Metz ..... 166/286
4,391,329 * 7/1983 Gallus ..... 166/336
5,884,698 * 3/1999 Hughes et al. ..... 166/117.6

OTHER PUBLICATIONS

TrueTone Sweet 16 Concrete and Mortar Colors, Specificiers Data Sheet, Section 04060, by Davis Colors, 1997, 2 pages.

Tammstech Concentrated Mortar Colors data sheet, by Tamms Industries Co., Mar. 1987, 1 page.

* cited by examiner

*Primary Examiner*—Hoang Dang
(74) *Attorney, Agent, or Firm*—Christensen O'Connor Johnson Kindness PLLC

(57) ABSTRACT

A method for locating a drill bit when drilling out cementing equipment from a casing of a wellbore. A first step involves placing in the casing of the wellbore at the time of placing cementing equipment, at least one coloured marker member. A second step involves monitoring cuttings during drilling for traces of colour. Penetration of a drill bit into the cementing equipment is indicated by coloured cuttings from the at least one coloured marker member.

2 Claims, 2 Drawing Sheets

METHOD FOR LOCATING A DRILL BIT WHEN DRILLING OUT CEMENTING EQUIPMENT FROM A WELLBORE

FIELD OF THE INVENTION

The present invention relates to a method and apparatus for locating a drill bit when drilling out cementing equipment form a wellbore.

BACKGROUND OF THE INVENTION

As a well is drilled, sections of casing are positioned in the wellbore to contain formation fluid within the formation and prevent such fluid from entering into the wellbore. In order to secure the casing in position, a cement slurry is pumped down the interior of the casing and then is forced up through the annulus between the casing and the wellbore. After solidifying, the cement locks the casing into the wellbore.

In order to prevent the cement slurry from returning to the interior of the casing, downhole cementing equipment is used that include check valves. A shoe is placed at the bottom of the casing string. The shoe may be either a float shoe which has a check valve or a guide shoe which does not. A float collar having a check valve is placed one to five sections of casing above the float shoe or guide shoe. Cement is used in the manufacture of the cementing equipment, as it is easily drillable. The cement used in the manufacture is similar in composition to the cement slurry that is pumped into the well to retain the casing string within the wellbore. Cementing plugs are used to separate the well fluid from the cement. A bottom plug is placed into the casing before cement is pumped into the casing. A top plug is placed on top of the cement after it has been completely pumped into the casing. During the pumping process, both of these plugs are displaced down on top of the float collar.

After the cementing is completed and the cement has solidified, the well operator will re-enter the casing with a drill bit to drill the well to a greater depth. In doing so, the operator will drill through the cementing plugs, the float collar, the cement remaining inside the casing between the float collar and the shoe, until the undrilled formation is reached.

At the present time it is very difficult to determine the location of the drill bit while drilling out the cementing equipment from a wellbore. This is most important if the cement plugs have not been completely displaced to the top of the float collar. It is not uncommon for this to occur if incorrect calculations have been made for displacement of fluid, the method of determine displacement of fluid volume is incorrect, or if the check valves in the cementing equipment did not operate properly.

SUMMARY OF THE INVENTION

What is required is a method for locating a drill bit when drilling out cementing equipment from a wellbore According to one aspect of the present invention there is provided a method for locating a drill bit when drilling out cementing equipment from a casing of a wellbore. The first step involves placing in the casing of the wellbore at the time of placing cementing equipment, at least one coloured marker member. A second step involves monitoring cuttings during drilling for traces of colour. Penetration of a drill bit into the cementing equipment is indicated by coloured cuttings from the at least one coloured marker member.

With the method, as described above, penetration into of the drill bit into the cementing equipment is readily determined by monitoring the cuttings for coloured cuttings from the marker member. The marker member need not be a separate component. Pigment can be added to the float collar, the shoe or both during fabrication. It is preferred, but not essential, that the float collar and the shoe be of differing colours so as to reduce the risk that the coloured cuttings will be inadvertently misconstrued.

According to another aspect of the present invention there is provided an apparatus for locating a drill bit when drilling out cementing equipment from a wellbore. The apparatus includes at least one coloured marker member incorporated as part of a downhole assembly of cementing equipment. It is preferred that either the float collar, the cementing shoe or both be used as the coloured marker member.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method will now be described with reference to FIGS. 1 through 4.

Figure 1:
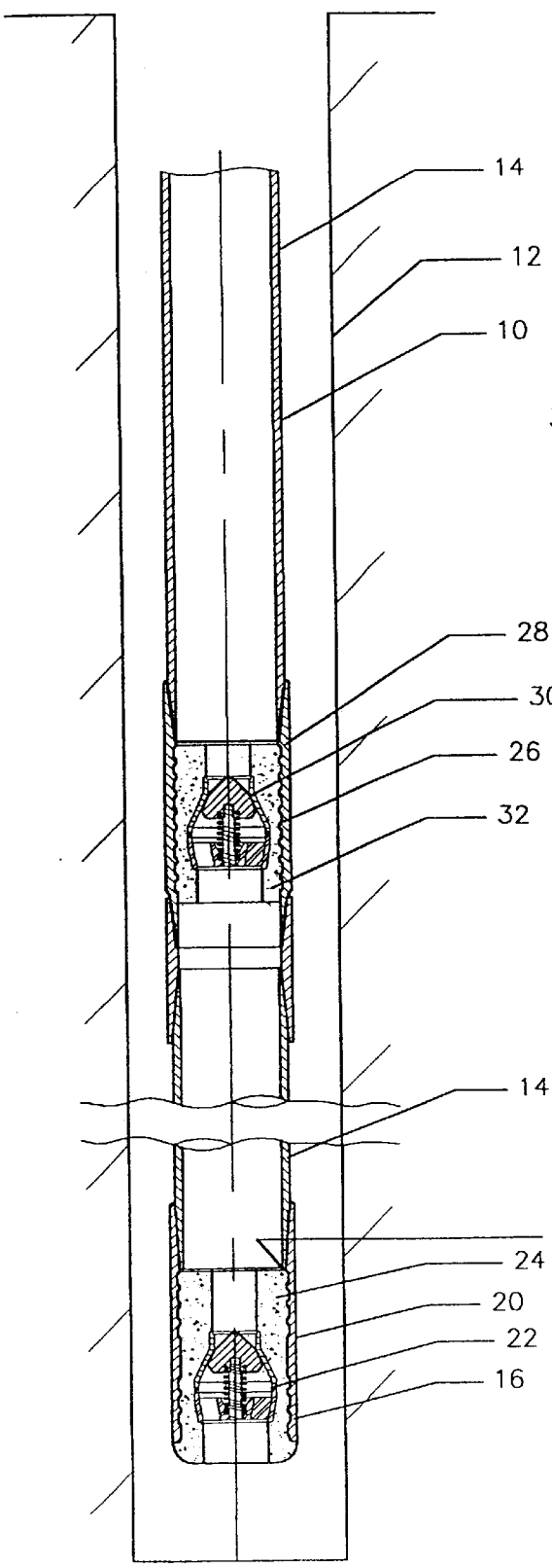
FIG. 1 is a side elevation view, in section, of a float collar and a float shoe in accordance with the teachings of the present invention, prior to cementing.

Referring to FIG. 1, a casing string 10 is illustrated positioned in a wellbore 12, prior to pumping of a cement slurry down casing string 10. Casing string 10 consists of a plurality of casing pipes 14. A float shoe 16 is positioned at bottom 18 of the lowermost ones of casing pipes 14. Float shoe 16 has a body 20. A check valve 22 is encased in pigment coloured cement 24 within body 20. Positioned one section of casing pipe above float shoe 16 is float collar 26. Float collar 26 has a body 28. A check valve 30 is encased in pigment coloured cement 32 within body 28. In accordance with the teachings of the method, pigment coloured cement 32 within body 28 of float collar 26 is intended to serve as one coloured marker member and pigment coloured cement 24 within body 20 of float shoe 16 is intended to serve as another coloured marker member.

Figure 2:
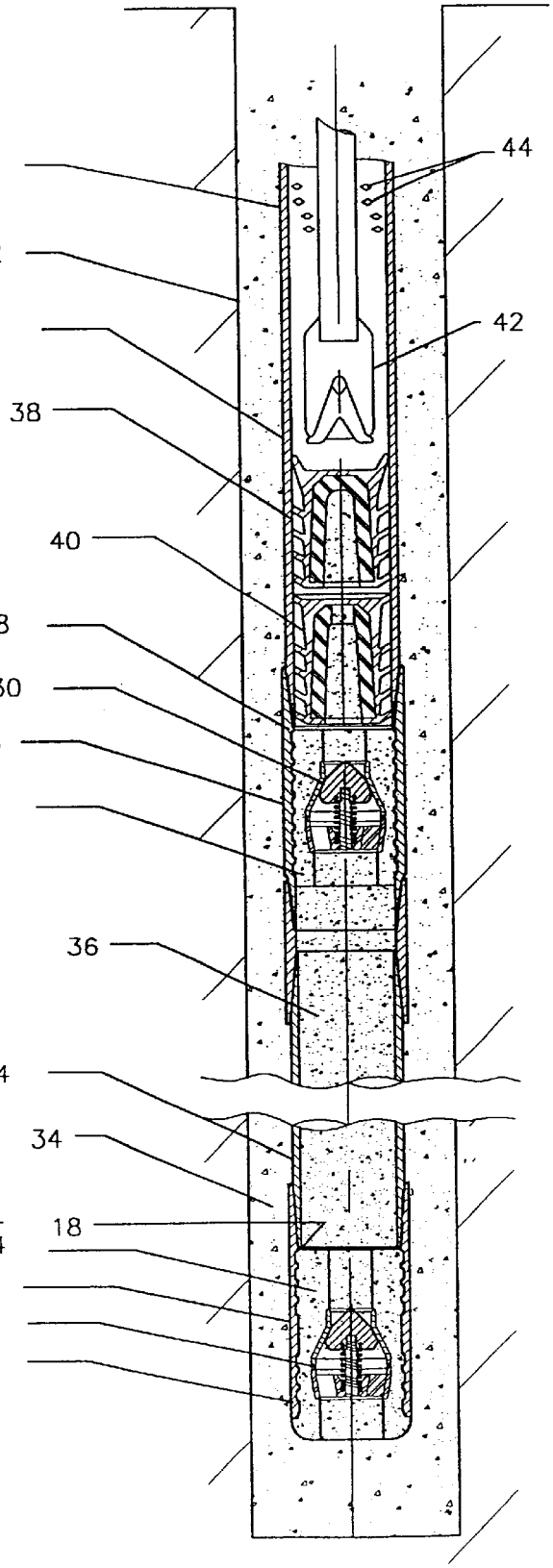
FIG. 2 is a side elevation view, in section, of the float collar and the float shoe illustrated in FIG. 1, with top and bottom plugs in position after cementing.

Referring to FIG. 2, there is illustrated how the components illustrated in FIG. 1 would appear after cement slurry is pumped down casing string 10. Cement slurry solidified in the annulus is identified by reference numeral 34. Cement slurry solidified in interior 36 of casing string 10 is identified by reference numeral 36. No coloration is added to cement slurry 34 and 36. It remains it's natural coloration which is readily distinguishable from the coloration of pigment coloured cement 24 and 32. A top plug 38 and a bottom plug 40 are shown positioned above float collar 26 where they would normally come to rest after being displaced during the process of pumping cement slurry down casing string 10. A drill bit 42 is shown in casing string 10 in the process of drilling. Cuttings 44 are shown rising to surface. Cuttings 44 are monitored during drilling for traces of colour. Penetration of drill bit 42 into float collar 26 is indicated by coloured cuttings from pigment coloured cement 32. Similarly, as drilling progresses, coloured cuttings from pigment coloured cement 24 indicates penetration of drill bit 42 into float shoe 16.

Figures 3, 4:
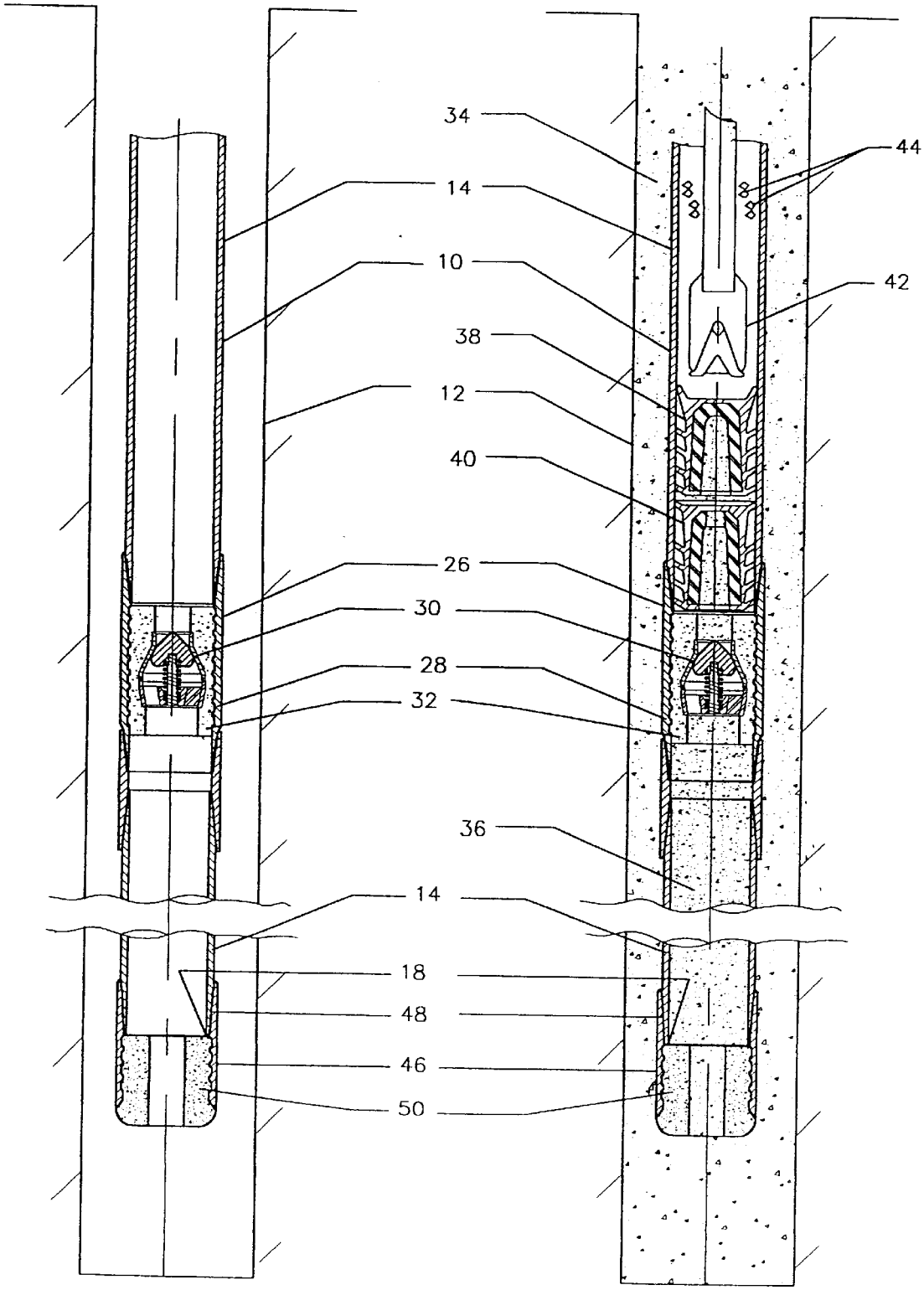
FIG. 3 is a side elevation view, in section, of a float collar and a guide shoe in accordance with the teachings of the present invention, prior to cementing.
FIG. 4 is a side elevation view, in section, of the float collar and the guide shoe illustrated in FIG. 3, with top and bottom plugs in position after cementing.

Referring to FIG. 3, an alternative configuration is illustrated in which a guide shoe 46 is substituted for float shoe 16. The difference between guide shoe 46 and float shoe 16 is that float shoe 16 has a check valve 22, whereas guide shoe 46 does not. Guide shoe 46 has a body 48 containing pigment coloured cement. Apart from this difference the components in FIG. 3 as compared to FIG. 1 and FIG. 4 as compared to FIG. 2 are identical and will be assigned the same reference numerals. In accordance with the teachings of the method, pigment coloured cement 32 within body 28 of float collar 26 is intended to serve as one coloured marker member and pigment coloured cement 50 within body 48 of guide shoe 46 is intended to serve as another coloured marker member. Referring to FIG. 4, cuttings 44 are monitored during drilling for traces of colour. Penetration of drill bit 42 into float collar 26 is indicated by coloured cuttings from pigment coloured cement 32. Similarly, as drilling progresses, coloured cuttings from pigment coloured cement 50 indicates penetration of drill bit 42 into guide shoe 46.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method for locating a drill bit when drilling out cementing equipment from a casing of a wellbore, comprising the steps of:

firstly, placing in the casing of the wellbore a float collar and a cementing shoe having bodies of coloured cement; and secondly, monitoring cuttings during drilling for traces of colour such that penetration of a drill bit into first the float collar and then the shoe is indicated by coloured cuttings.

2. A method for locating a drill bit when drilling out cementing equipment from a casing of a wellbore, comprising the steps of:

firstly, placing in the casing of the wellbore a float collar having a pigment coloured cement body of a first colour and a cementing shoe having a pigment coloured cement body of a second colour; and secondly, monitoring cuttings during drilling for traces of the first colour and the second colour such that penetration of a drill bit into first the float collar and then the shoe is indicated by cuttings of one of the first colour and the second colour.

* * * * *